US011794315B2

(12) United States Patent
Birmelin

(10) Patent No.: US 11,794,315 B2
(45) Date of Patent: Oct. 24, 2023

(54) KEY AND CORRESPONDING METHOD OF USE

(71) Applicant: Neoperl GmbH, Mullheim (DE)

(72) Inventor: David Birmelin, Mullheim (DE)

(73) Assignee: Neoperl GmbH, Müllheim (DE)

( * ) Notice: Subject to any disclaimer, the term of this patent is extended or adjusted under 35 U.S.C. 154(b) by 559 days.

(21) Appl. No.: 16/810,134

(22) Filed: Mar. 5, 2020

(65) Prior Publication Data

US 2020/0282528 A1 Sep. 10, 2020

(30) Foreign Application Priority Data

Mar. 8, 2019 (DE) ..... 202019101317.6

(51) Int. Cl.
*B25B 13/50* (2006.01)
*E03C 1/08* (2006.01)

(52) U.S. Cl.
CPC ..... *B25B 13/50* (2013.01); *E03C 1/08* (2013.01)

(58) Field of Classification Search
CPC ..... B25B 13/50; E03C 1/08
USPC ..... 81/176.15, 176.2, 124.7
See application file for complete search history.

(56) References Cited

U.S. PATENT DOCUMENTS

| | | | | |
|---|---|---|---|---|
| 873,009 | A * | 12/1907 | Baxter | F16B 37/00 54/47 |
| 6,971,591 | B2 * | 12/2005 | Fleischmann | E03C 1/084 239/465 |
| 7,644,876 | B2 * | 1/2010 | Weis | E03C 1/086 239/397 |
| 2018/0071897 | A1 | 3/2018 | Banko | |

FOREIGN PATENT DOCUMENTS

| | | |
|---|---|---|
| DE | 2705490 | 8/1978 |
| DE | 4121037 | 8/1992 |
| DE | 29702143 | 5/1997 |
| DE | 102007029448 | 12/2008 |
| DE | 202015102376 | 9/2016 |
| DE | 102016011092 | 3/2018 |
| WO | 2011154063 | 12/2011 |

* cited by examiner

*Primary Examiner* — Hadi Shakeri
(74) *Attorney, Agent, or Firm* — Volpe Koenig

(57) ABSTRACT

For a sanitary attachment (3), in which at least one part (2) can be transferred from a fixed position (8) into a released position (9) using a rotational movement, a receiver (11) designed as part of a key (1) is provided, with which the part (2) can be rotated, and which further features a ridge (24) that allows for engagement with an indentation (14) on the back of the part (2) and thus for axial detachment.

13 Claims, 5 Drawing Sheets

KEY AND CORRESPONDING METHOD OF USE

INCORPORATION BY REFERENCE

The following documents are incorporated herein by reference as if fully set forth: German Patent Application No. 20 2019 101 317.6, filed Mar. 8, 2019.

TECHNICAL FIELD

The invention concerns the use of a key to remove at least one part of a sanitary attachment, where the part has a non-circular outer contour and can be adjusted through a rotational movement around an axis of rotation between a fixed position, in which the part is held in place, and a released position, in which the part can be detached in the direction of detachment.

The invention also concerns a key that can be used to remove at least one part of a sanitary attachment with a receiver determining the direction of attachment, which has a non-circular inner contour.

BACKGROUND

It is well-established that sanitary attachments, which serve, for example, to act as jet regulators or jet formers can be attached onto or into an outlet opening of a sanitary fitting. In this context, it has been suggested that part of the attachment or the entire attachment should be manufactured from plastic. For hygiene reasons, it is necessary in some circumstances to replace the part or the entire attachment regularly. This can be achieved, for example, by clipping the part or the entire attachment onto or into the outlet opening.

It has since become clear that the reverse movement—namely the movement involved in loosening at least one part—is more difficult to achieve. This is due to the fact that in conditions with particularly hard water, calcification causes the part to bond very firmly to the supporting metal part.

Keys for removing jet regulators or similar attachments are already known and are used, for example, to screw outlet nozzles or other parts into outlets on the fitting. A common feature of previous solutions is the use of a thread to enable the connection to the fitting or supporting part.

This invention is concerned with simplifying the replacement of at least one part during this process.

SUMMARY

A key having one or more features of the invention is provided to resolve the issue set out above. In particular, this invention provides that when using a fitting of the type described, a receiver on the key which corresponds to the non-circular contour is positioned onto the part, allowing the key to be rotated around an axis of rotation, so that, first, the part is rotated into the released position and, second, the receiver grips the non-circular outer contour from the back, and that the key can be detached with the part in the direction of detachment. The advantage of this is that there is no need for a thread to automatically generate an axial movement to loosen the part when the part is turned.

The at least one part of the sanitary attachment may either be combined with another part to form the sanitary attachment, or the sanitary attachment may itself form only one part. It is preferable for the at least one part of the sanitary attachment to be the part that is intended for frequent replacement, i.e. due to the choice of material for this part. Here, it has been established that for reasons of hygiene and/or stability, components made of plastic and/or rubber require more frequent replacement than components made of metal. In particular, the key for removing the sanitary attachment could therefore be used, for example, when the at least one part is the only component of the sanitary attachment.

One preferable design could allow for the part to be clipped into the fixed position. This would mean that the key could be used for sanitary attachments that are simple to attach.

One preferable design could allow for the part to be attached in the fixed position without the use of a thread connection. This would mean that the key could be used for sanitary attachments that are simple in design and/or have smooth surfaces to prevent contamination. In particular, it is not necessary for a thread to be used in cases where a metal support is used for the part.

One preferable design could include a non-circular outer contour that features an indentation, at least in some sections. This would provide an efficient contact surface for the key to remove the part.

One preferable design could allow for the part to be inserted into or onto an outlet opening of a sanitary fitting. As such, the key could be used for sanitary fittings where the part being replaced has or will have an effect on the flow of water through the outlet opening as part of its design.

One preferable design could allow for the part to be designed with a particular outlet structure. As such, the key could be used for sanitary attachments where the final water jets are produced using a particular outlet geometry.

One preferable design could allow for the part to be fitted with a jet regulator and/or a jet former. As such, the key could be used for sanitary attachments that provide a desired flow rate and/or jet quality (for example, ventilated or non-ventilated jets).

One preferable design could allow for a rotation stop to be formed as part of the receiver, which rests against the part when the receiver grips onto the back of the part. This would mean that the part could be rotated using the key, for example, to turn the part into the released position and/or to bend the part—in particular through the use of a spring tongue to be described in more detail—in order to reach the released position. It is preferable for the rotation stop to be placed downstream of the receiver in the direction of detachment. This makes achieving coordination between the impact of the rotation force and the detachment effect more straightforward.

One preferable design could allow for the movement of the key to be triggered by a lever that corresponds to the axis of rotation. This would allow for increased torque to be applied to the at least one part.

One preferable design could allow for a locking tongue on the part to be bent during the movement of the key to release the part. One advantage of this is that it allows for the at least one part to be released, even where complete rotation is obstructed, for example.

In accordance with the invention, a solution to the issue set out above is provided through the use of a key with additional features described herein. In particular, it is provided that in the case of a key of the type described above, a raised ridge can be included downstream of the receiver in the direction of attachment. This ridge allows for an indentation formed on a non-circular outer contour corresponding to the inner contour of a part inserted into the receiver to be gripped from behind when the inner contour is rotated around an axis of rotation relative to the outer contour. This results in a coupling between the key and the at least one part, in which both a rotational movement and an independent axial movement are achieved by the part and the key.

In accordance with the invention, the key described here can therefore be installed or used for the purpose described above.

One preferable design could allow for a rotation stop to be fitted onto the receiver. This would allow for the at least one part to be easily rotated with the key. It is particularly advantageous if the rotation stop is placed downstream in the direction of attachment. This makes it easy to ensure that the inner contour engages with the back of the at least one part, while the rotation stop rests against and thus engages the at least one part. A combined twist-pull movement—similar to a bayonet lock movement—can therefore be carried out to remove the part with the key.

One preferable design could allow for a lever to be fitted relative to the receiver. This would allow sufficient break-away torque to be easily applied.

One preferable design could allow for the receiver to be designed such that it is fully enclosed. This would allow for the at least one part to grip the receiver securely on all sides.

BRIEF DESCRIPTION OF THE DRAWINGS

The invention is described in greater detail below through the use of an example, but it should be noted that its scope is not restricted to the example given. Further possible embodiments can be achieved by combining the features of one or more claims with one another and/or with one or more features of the design example.

In the drawings.

DETAILED DESCRIPTION

The figures are described together below.

Figure 1:
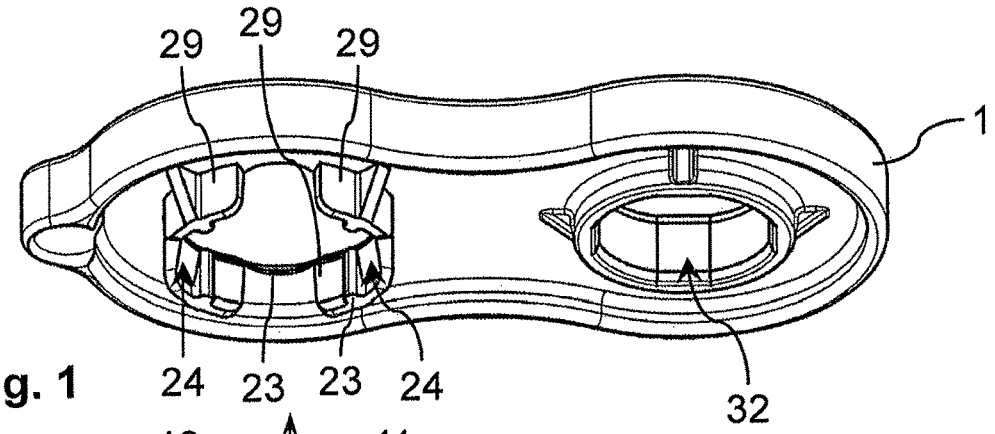
FIG. 1 a view of a key according to the invention, shown from below, i.e. on its side facing away from the sanitary fitting in the position of use, FIG. 2 the key from FIG. 1, shown from above, i.e. on its side facing the sanitary fitting in the position of use, FIG. 3 a part of the sanitary fitting with attachment attached, FIG. 4 the sanitary fitting as shown in FIG. 3 in oblique view from above, with an enlarged detail view of a cross-section of the attachment, FIG. 5 the key from FIG. 1 attached to an attachment according to FIG. 3, shown from above, FIG. 6 the elements of FIG. 5, shown in a perspective view from below, FIG. 7 the elements of FIG. 5, shown from the outlet side, FIG. 8 a reproduction of FIG. 5 with a rotated key, FIG. 9 a reproduction of FIG. 6 with a rotated key, FIG. 10 a reproduction of FIG. 7 with a rotated key, FIG. 11 a reproduction of FIG. 5 with a key that has rotated further than in FIG. 8, FIG. 12 a reproduction of FIG. 6 with a key that has rotated further than in FIG. 9, FIG. 13 a reproduction of FIG. 7 with a key rotated further than in FIG. 10, FIG. 14 a reproduction of FIG. 5 with one part removed, FIG. 15 a reproduction of FIG. 6 with one part removed, and FIG. 16 a reproduction of FIG. 7 with one part removed.
Figure 2:
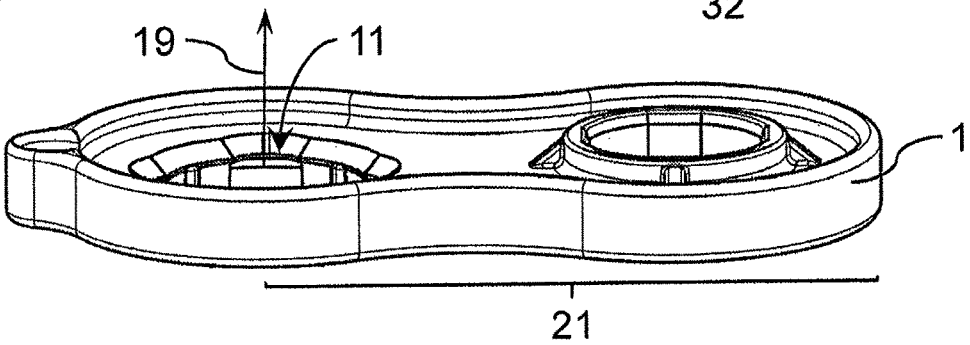

FIGS. 1 and 2 show a key marked 1 in its entirety, using which a part 2 of a sanitary attachment 3 can be removed from a sanitary fitting 25.

Figure 4:
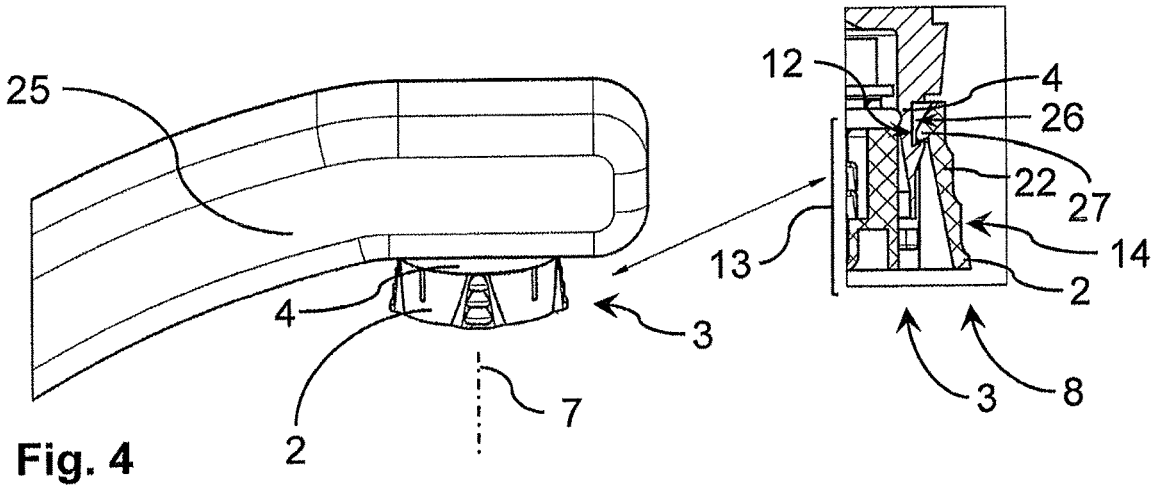
Figure 11:
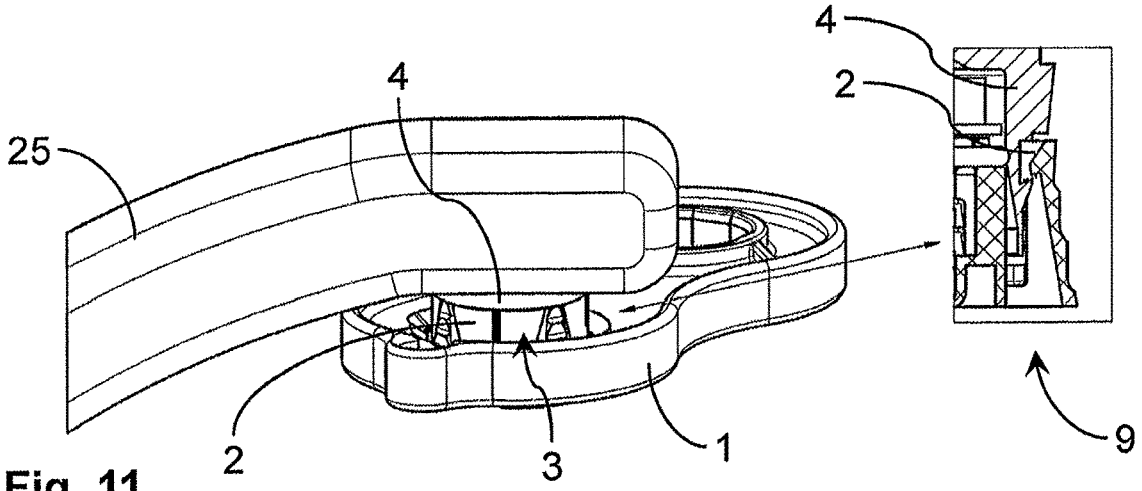
Figure 14:
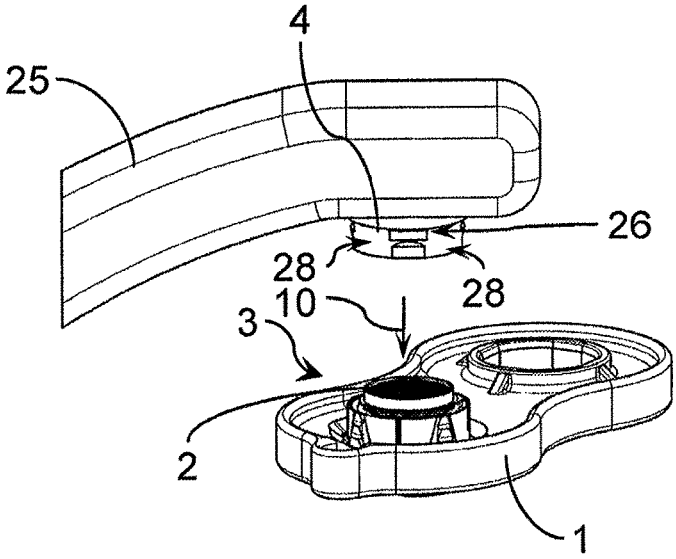

As can be seen—particularly from the detailed illustrations in FIGS. 4 and 11 and in the dismantled form shown in FIG. 14—the part 2—here made of plastic—is held in the position of use on a support 4—here made of metal. As shown in this example, the support 4 can be part of the sanitary fitting 25 and can, for example, be made as a single piece or as a separate piece that is then connected to it, in particular, screwed on to it. The support 4 can also form a further component of the sanitary attachment 3.

In the design example shown in FIGS. 1 to 16, the sanitary attachment 3 is therefore identical to the at least one part 2.

On the outer circumference of the support 4 there is a groove 26 which is restricted to one part of the circumference. The support 4 on both sides of the groove 26 has a flat surface. Three further grooves are featured on the support 4 and offset by 90°.

On the part 2, a locking catch 27 forms part of a locking tongue 22. In the position of use, the locking catch engages the groove 26 and therefore attaches the part 2 axially to the support 4. The locking catch 27 and the groove 26 are positioned in such a way that they interlock as a click-on connection 12 and can securely withstand even greater pressure, which may arise, for example, from the working pressure sustained by the sanitary fitting 25 during operation. This working pressure is essentially transferred to the part 2 because it has considerable flow resistance by virtue of its jet regulator 17 (for example, a quantity control device, known per se) and/or a jet former 18 (for example a steel aerator, known per se). The part 2 has an outlet structure 16 (known per se) located on the outlet side.

Three further locking catches engage in the same way in the additional grooves on the support 4 already mentioned.

If the part 2 is rotated 45° around an axis of rotation 7, which corresponds approximately to a longitudinal axis of the sanitary attachment 3, the locking catches 27 are released from the grooves 26 into a flat-surface area 28 (see FIG. 14), in which the part 2 can be detached in the axial direction. (The terms axial, radial and circumferential direction refer here to the axis of rotation 7). Here, the locking tongues 22 are bent upwards because the flat-surface area 28 is designed to have a larger radius than the bottom portion of the groove 26.

Figure 3:
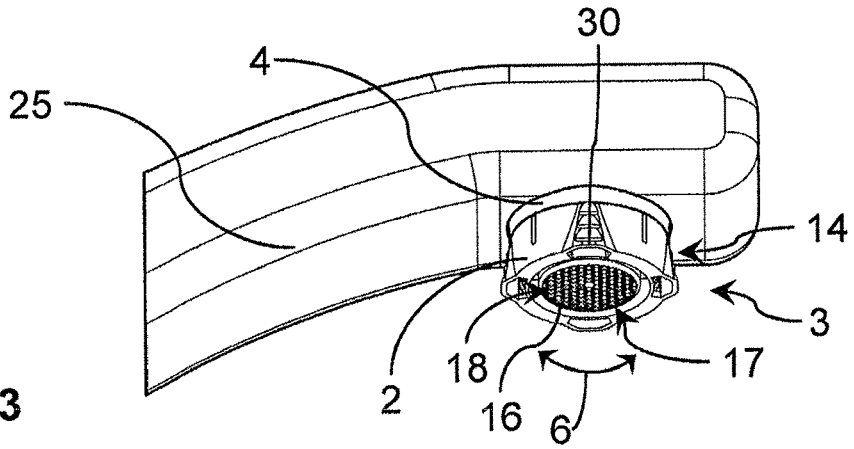

The position of the part 2 on the support 4, where the locking catches 27 hook onto the groove 26, can be described as being in a fixed position 8, as is shown in FIG. 3. To reach this position, the part 2 can be placed onto the support 4 and therefore into an outlet opening 15 (see FIG. 15) of the sanitary fitting 25, and moved axially so that the locking catches 27 fall into the grooves 26.

The position of the part 2 on the support 4, where the locking catches 27 are on the flat-surface area 28 and therefore outside the grooves 26, can be described as being in the released position 9, as shown in FIG. 11. In the detailed illustration, the locking catches have been lifted out of the groove 26. This is due to the locking catches 27 extending beyond a particular circumferential section. In the illustration, they are already resting on the flat-surface area 28 behind the section plane, which is radially raised in relation to the bottom part of the groove 26. In this position, the part 2 can be detached in the direction of detachment 10, which often coincides with or is parallel to the axis of rotation 7.

In other possible design examples, securing the part 2 to the support 4 is resolved using another method. However, these examples also define fixed and released positions.

The part 2 has a non-circular outer contour 5, which means that it can be turned by hand. Often, however, the part 2 will be so tightly secured to the support 4 that it cannot be loosened by hand.

In order to increase the torque, the key 1 is provided, which has a receiver 11 that is inserted into the part 2 in the direction of attachment 19. Here, the key 1 features an additional length onto which a lever 21 can be attached. Further, an additional receiver 32 may be designed as part of the key 1, for example for unscrewing the support 4 or for a conventional, screw-in sanitary attachment 3.

Figure 5:
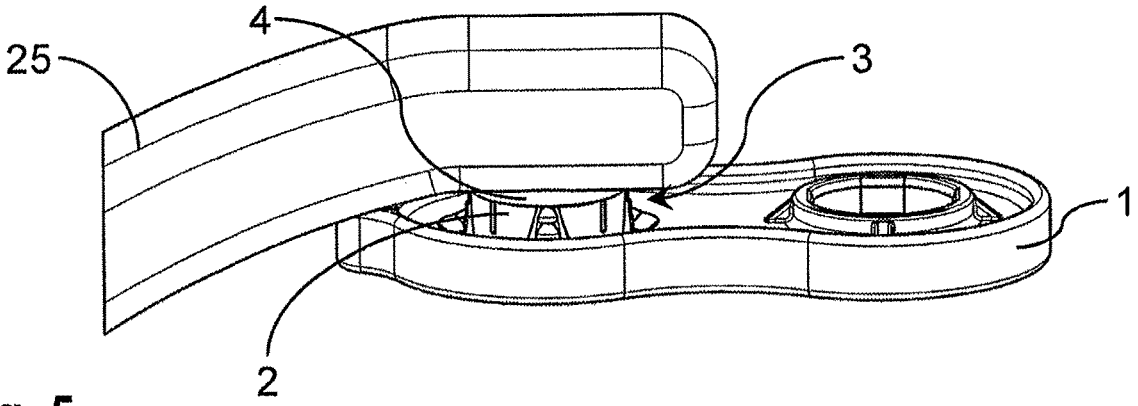
Figure 6:
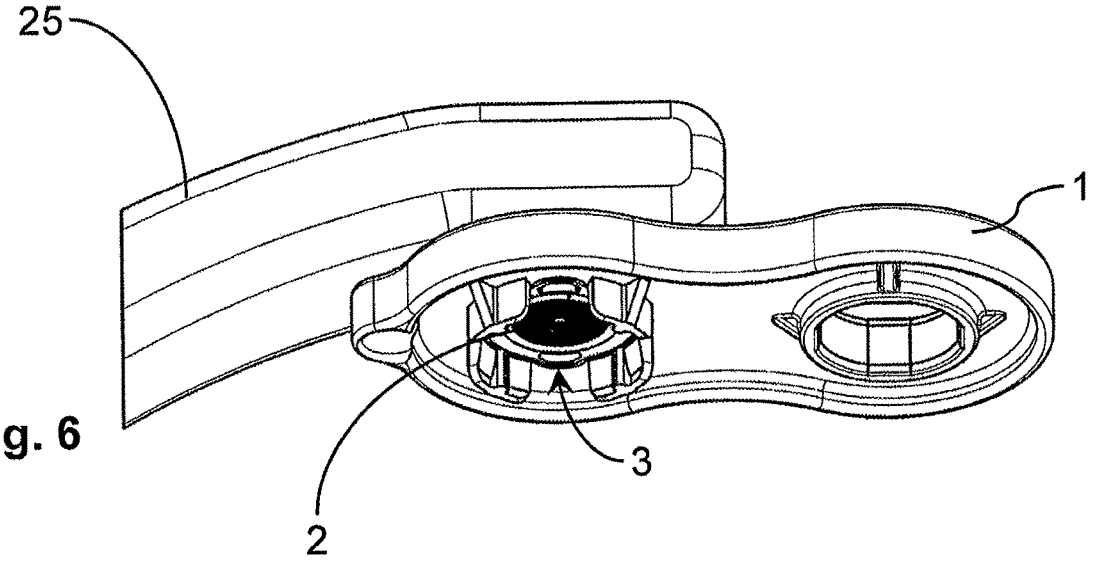
Figure 7:
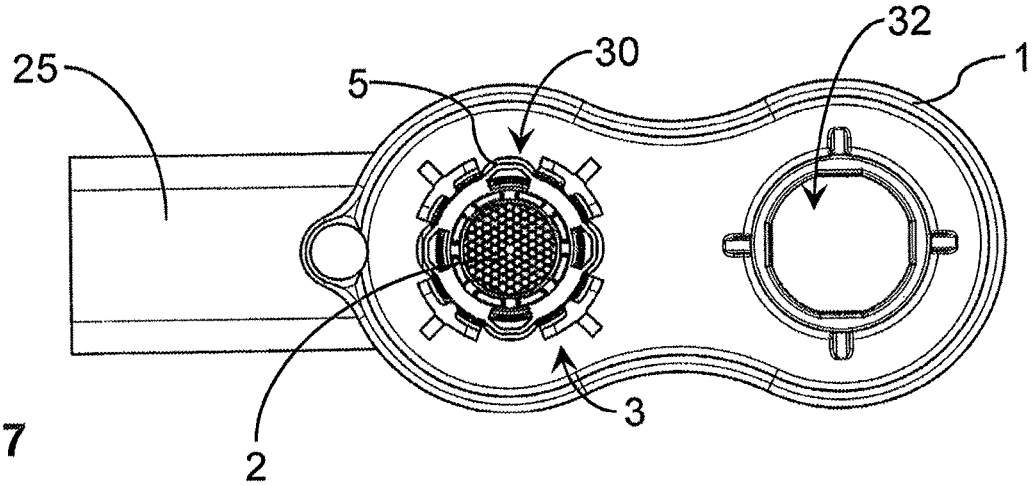

This results in the configuration shown in FIGS. 5 to 7.

The receiver 11 has an inner contour 23, which fits together with the outer counter 5 of the part 2. In particular, the inner contour 23 has four protrusions 30 that match those on part 2, which act as a handle for manual rotation.

A number of brackets 29 are designed behind the inner contour 23 in the direction of attachment 19, which form a ridge 24 relative to the inner contour 23. (In contrast, the additional receiver 32 has no indentations and thus no ridge).

The part 2 has an indentation 14 on the outer circumference of each protrusion 30. The ridge 24 is shaped so as to correspond with the indentation 14.

Figure 8:
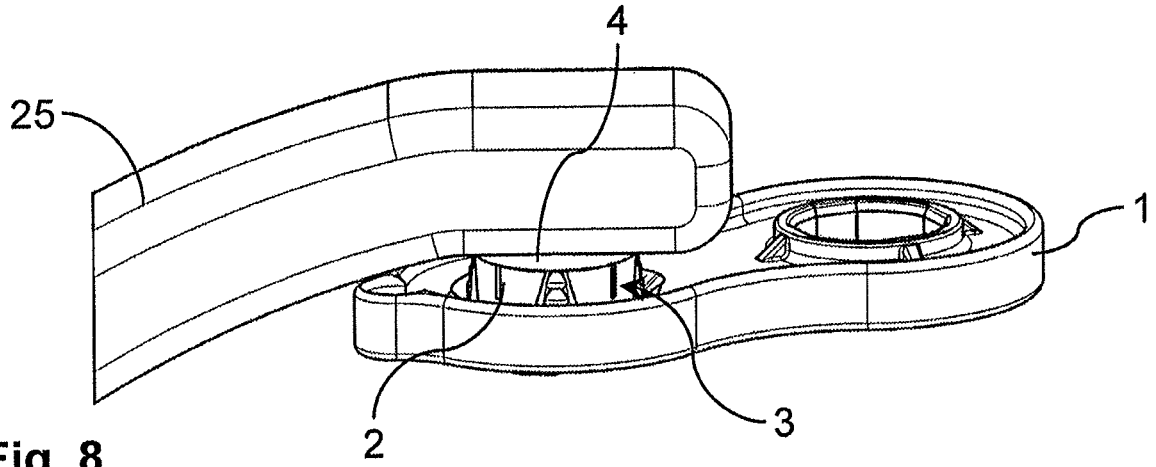
Figure 9:
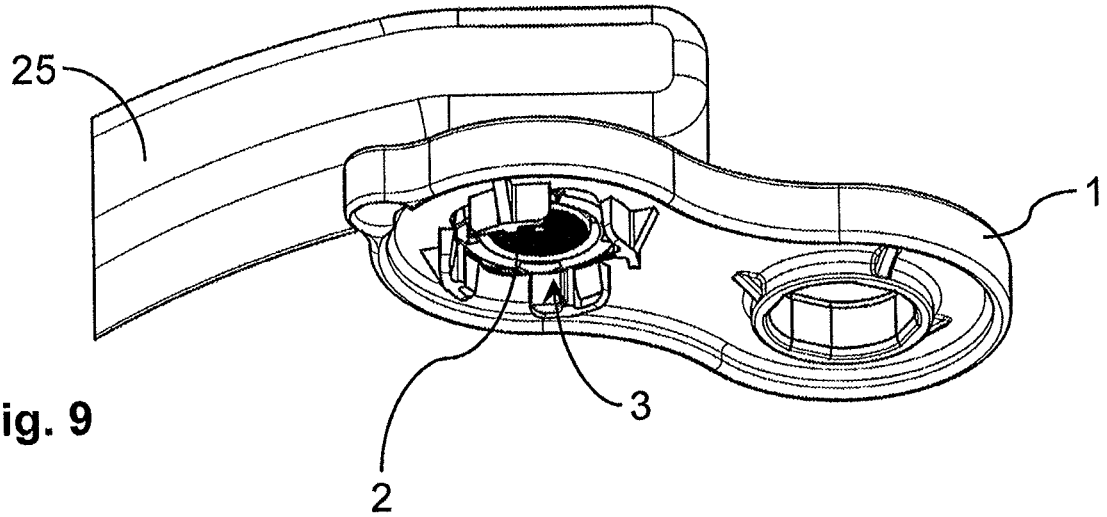
Figure 10:
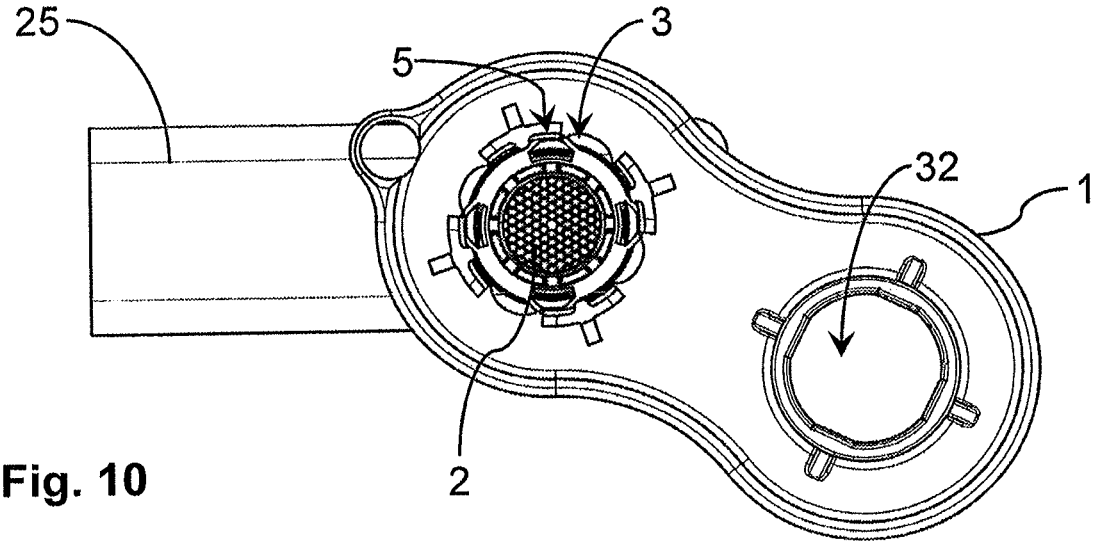

When the key 1 is now turned or rotated around the axis of rotation 7, the configuration shown in FIGS. 8 to 10 is produced: the outer contour 5 of the part 2 engages with the inner contour 23 on the receiver 11 using its indentations 14 by the ridge 24. This is possible because the inner contour 23 allows sufficient rotation clearance for the outer contour 5.

On each of the brackets 29 there is a rotation stop 20, which now comes into contact with the respective protrusion 30.

Figure 12:
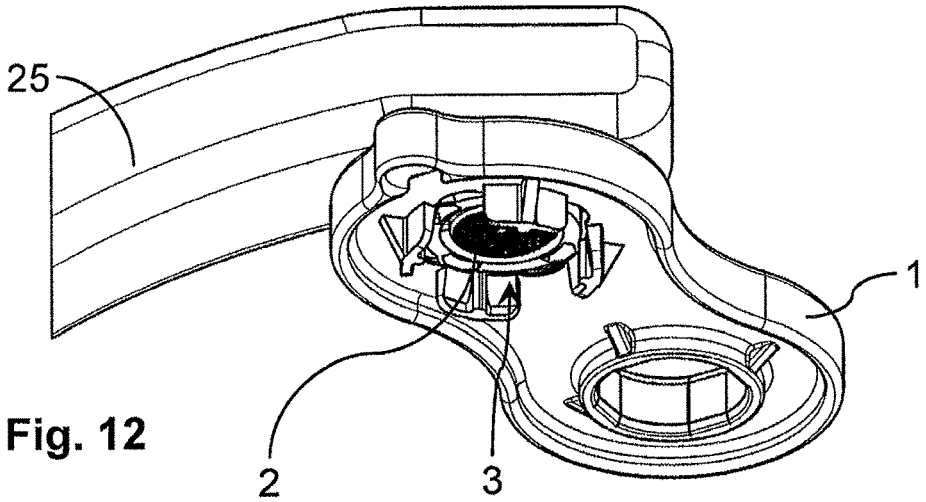
Figure 13:
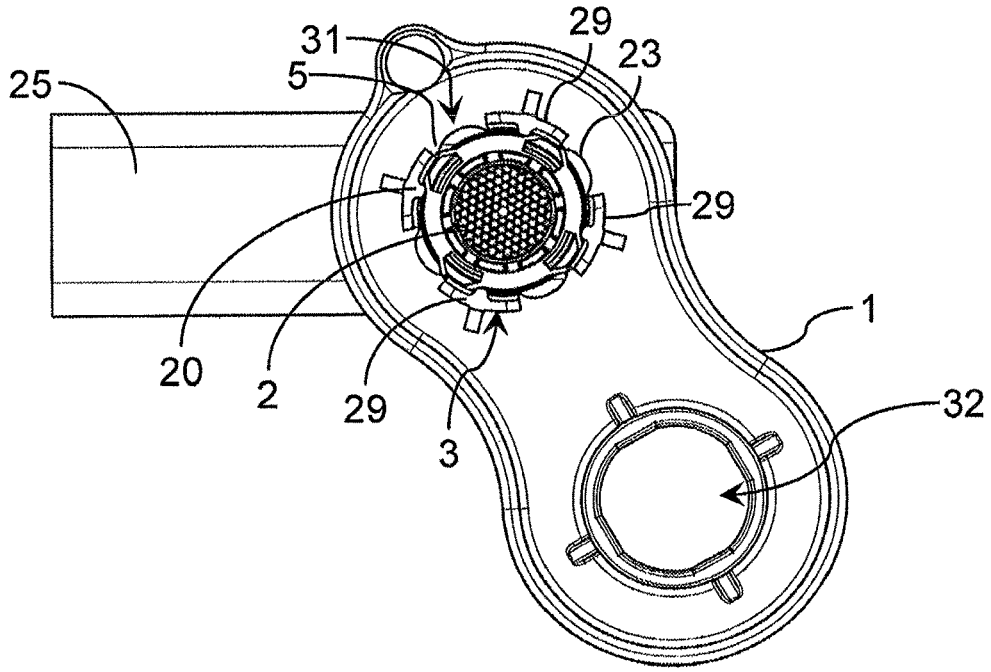

When the key 1 is turned further in the same direction, the part 2 moves around the axis of rotation 7. This continues until the released position 9 is achieved as shown in FIGS. 11 to 13.

In this released position 9, the click-on connection 12 is released, because each of the locking catches 27 has reached the flat-surfaced area 28.

The part 2 can now be detached from the support 4 by an axially aligned detaching movement in the direction of detachment 10. Since the receiver 11 engages behind the part 2 as described above, this detaching movement can be transferred from the key 1 to the part 2.

Figure 15:
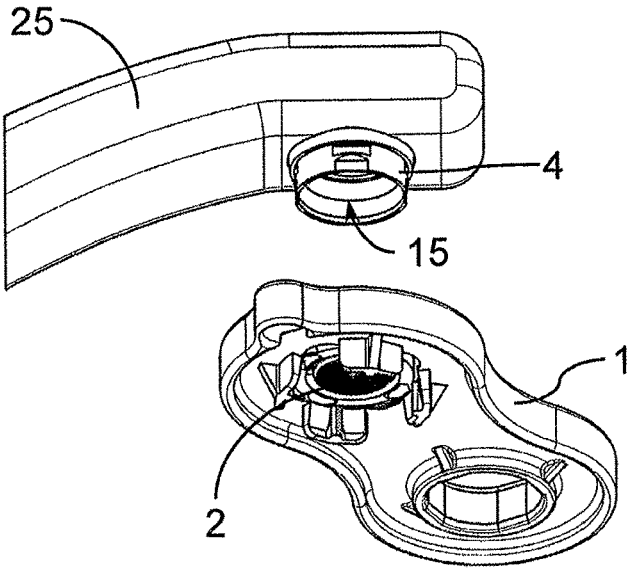
Figure 16:
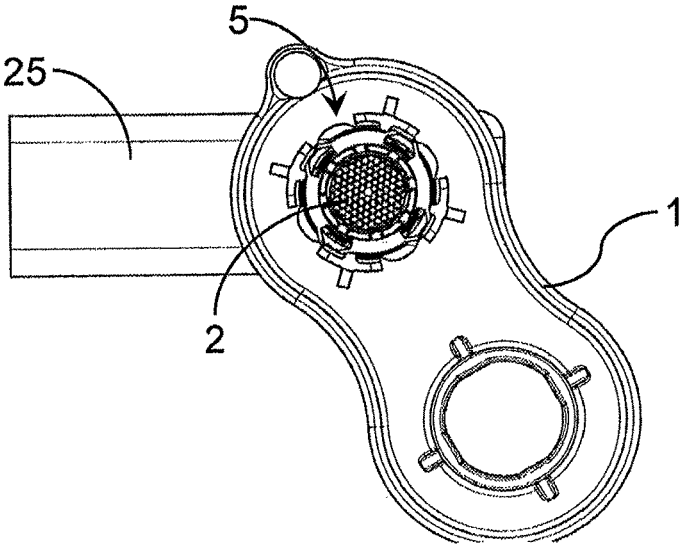

This results in the configuration shown in FIGS. 14 to 16. The part 2 has been removed and can now be replaced.

In the case of a sanitary attachment 3, in which at least one part 2 can be transferred by a rotational movement from a fixed position 8 to a released position 9, it is provided that a receiver 11 should be provided on a key 1, which will allow the part 2 to be rotated, as well as for a ridge 24 to be provided in order to ensure a grip on the back of part 2 using an indentation 14 and thus to detach it axially.

LIST OF REFERENCE NUMBERS

1 Key
2 Part
3 Sanitary attachment
4 Support
5 Outer contour
6 Rotational movement
7 Axis of rotation
8 Fixed position
9 Released position
10 Direction of detachment
11 Receiver
12 Click-on connection
13 Non-threaded area
14 Indentation
15 Outlet opening
16 Outlet structure
17 Jet regulator
18 Jet former
19 Direction of attachment
20 Rotation stop
21 Lever
22 Locking tongue
23 Inner contour
24 Ridge
25 Sanitary fitting
26 Groove
27 Locking catch
28 Flat-surface area
29 Bracket
30 Protrusion
31 Recess
32 Additional receiver

The invention claimed is:

1. A method of removing at least one part (2) of a sanitary attachment (3), the part (2) having a non-circular outer contour (5) and being adjustable through a rotational movement (6) around an axis of rotation (7) between a fixed position (8), in which the part (2) is held in place, and a released position (9), in which the part (2) can be detached in a direction of detachment (10), the method comprising:

providing a receiver (11) having a complementary non-circular outer contour on a key (1);

placing the key onto the part (2);

rotating the key (1) around the axis of rotation (7) so that, first, the part (2) is also rotated into the released position (9) and, second, the receiver (11) engages with the non-circular outer contour (5) via at least one ridge (24) of the receiver (11) extending circumferentially and engaging axially behind an indentation (14) defined by the non-circular outer contour (5) in the direction of detachment (10);

detaching the key (1) with the part (2) by pulling off the key (1) together with the part (2) in the direction of detachment (10).

2. The method according to claim 1, further comprising clipping the part (2) into the fixed position (8) via a locking catch (27) of the part (2) engaging in a groove (26) in a support (4).

3. The method according to claim 1, wherein the part (2) is fixed in the fixed position (8) without a threaded connection.

4. The method according to claim 1, wherein the part (2) is inserted into or onto an outlet opening (15) of a sanitary fitting (25).

5. The method according to claim 1, wherein the part (2) at least one of encompasses an outlet structure (16), contains a jet regulator (17), or contains a jet former (18).

6. The method according to claim 1, further comprising providing a rotation stop (20) as part of the receiver (11) which then comes into contact with the part (2) when the receiver (11) engages with a back of the part (2).

7. The method according to claim 1, further comprising producing the rotation of the key (1) by a lever (21) which is operable about the axis of rotation (7).

8. The method according to claim 1, further comprising, during the rotation of the key (1), bending a locking tongue (22) on the part (2), allowing the part (2) to be released.

9. A key (1) for removing at least one part (2) of a sanitary attachment (3), the part (2) having a non-circular outer contour (5) and being adjustable through a rotational movement (6) around an axis of rotation (7) between a fixed position (8), in which the part (2) is held in place, and a released position (9), in which the part (2) can be detached in a direction of detachment (10), the key comprising:

a receiver (11) that defines a direction of attachment (19) along an axis of rotation (7), the receiver (11) has a first portion that engages on to the part (2) first as the tool is applied to the part (2) in the direction of attachment (19), and includes a second portion that at least one of approaches or contacts the part (2) last as the key is fully engaged onto the part (2), and the receiver (11) includes a non-circular inner contour (23);

a ridge (24) provided on the receiver (11) at the first portion that is downstream in the direction of attachment (19) and protrudes radially inwardly toward the axis of rotation (19) and tapers radially outwardly as it extends toward the second portion, the ridge (24) extends circumferentially and is configured to engage axially behind an indentation (14) in a non-circular outer contour (5) of the part (2) that corresponds to the inner contour (23) of the receiver (11) when the inner contour (23) is rotated around the axis of rotation (7) relative to the outer contour (5).

10. The key according to claim 9, further comprising a rotation stop (20) on the receiver (11).

11. The key according to claim 9, further comprising a lever (21) located in line with the receiver (11).

12. The key according to claim 9, wherein the receiver (11) is configured to be locked on all sides.

13. A set comprising a key (1) and a part (2) of a sanitary attachment (3), the part (2) includes a non-circular outer contour (5) defining an indentation (14), which provides a contact surface or point of attack for the key (1), and the part (2) being adjustable through a rotational movement (6) around an axis of rotation (7) between a fixed position (8), in which the part (2) is held in place, and a released position (9), in which the part (2) can be pulled off in a direction of detachment (10), the key (1) is configured for detaching the part (2) from the sanitary attachment (3) and comprises:

a receiver (11) defining a direction of attachment (19) of the key (1) onto the part (2), the receiver (11) includes a non-circular inner contour (23) and the outer contour (5) of the part (2) corresponds to the inner contour (23) of the receiver, a ridge (24) positioned downstream of the receiver (11) in the direction of attachment (19), wherein the ridge (24) of the key (1) is configured to grip the indentation (14) of the part (2) from behind upon rotation of the inner contour (23) of the key (1) around an axis of rotation relative to the outer contour (5) of the part (2) inserted into the receiver (11), and subsequently, the key (1) together with the part (2) are adapted to be pulled off by an axial pulling movement in the direction of detachment (10), with the ridge (24) gripping the part (2) from behind.

* * * * *